US005278733A

United States Patent [19]

St. Thomas

[11] Patent Number: 5,278,733

[45] Date of Patent: Jan. 11, 1994

[54] LIGHTING APPARATUS FOR ROLLER SKATE

[76] Inventor: Garth St. Thomas, 3889 Arrowhead Dr., El Dorado Hills, Calif. 95762

[21] Appl. No.: 27,778

[22] Filed: Mar. 8, 1993

[51] Int. Cl.[5] ..... F21L 5/00

[52] U.S. Cl. ..... 362/78; 362/103; 362/253; 280/811

[58] Field of Search ..... 362/35, 103, 78, 253, 362/72, 80; 280/809, 811, 11.19, 816

[56] References Cited

U.S. PATENT DOCUMENTS 3,789,208 1/1974 Lewis ..... 362/78
4,240,132 12/1980 Wickman ..... 362/103
4,298,910 11/1981 Price ..... 362/35
4,363,502 12/1982 Bakerman ..... 362/103
4,367,515 1/1983 Beard ..... 362/103
4,383,244 5/1983 Knauff ..... 362/78

*Primary Examiner*—Richard R. Cole
*Assistant Examiner*—Y. Quach
*Attorney, Agent, or Firm*—Thomas R. Lampe; 10

[57] ABSTRACT

A decorative lighting apparatus for connection to a roller skate wheel and axle supporting the wheel includes a unitary housing which is positioned about the axle and brought into frictional engagement with the wheel. A battery operated light bulb is connected to the housing, and the housing and bulb rotate with the skate wheel about the axle.

5 Claims, 3 Drawing Sheets

LIGHTING APPARATUS FOR ROLLER SKATE

TECHNICAL FIELD

This invention relates to lighting apparatus for use with a roller skate. More particularly, the lighting apparatus is for connection to a roller skate wheel and an axle rotatably supporting the roller skate wheel. The apparatus rotates with the wheel to provide an attractive, decorative light display.

BACKGROUND ART

It is known in the art to attach lights to roller skates. Such lights may function as miniature head lamps to illuminate the ground or other support surface in front of the skater. It is also known, however, to apply lights to roller skates primarily for decorative purposes.

U.S. Pat. No. 3,789,208, issued Jan. 29, 1974, illustrates an arrangement of the latter type. More particularly, the device shown in U.S. Pat. No. 3,789,208 is for attachment to a conventional skate wheel of a roller skate. The suggested form of attachment is a magnet connected to the skate wheel axle. The light apparatus is of multi-component construction including a socket attached to the axle, a rotary disk engaging the skate wheel and rotatable therewith, and a housing which is non-rotatable.

A battery powered light bulb is disposed within the non-rotatable housing, the light bulb being observable through a transparent cover attached to the non-rotatable housing. The rotatable disk functions as a switch turning the light bulb on and off during rotation of the roller skate wheel, although, as stated above, the housing and the light bulb do not rotate.

The arrangement of U.S. Pat. No. 3,789,208 is relatively complex and readily dislodged from the roller skate to which it has been attached, creating potential for injury. Furthermore, the decorative affect produced thereby is less than satisfactory in that the light bulb remains stationary relative to the skate and does not rotate with the wheel.

DISCLOSURE OF INVENTION

The present invention relates to decorative lighting apparatus for roller skates which is relatively inexpensive in construction. Furthermore, the apparatus lends itself to attachment to a roller skate wheel and an axle rotatably supporting the wheel in a secure manner. That is, the lighting apparatus will remain attached to the skate even if subjected to impact. In the arrangement of the present invention the light bulb employed therein rotates with the roller skate wheel, providing a pleasing decorative affect.

The decorative lighting apparatus of the present invention is, as indicated above, for connection to a roller skate wheel and to an axle rotatably supporting the wheel. The axle, as is conventional, has a threaded distal end and the roller skate additionally includes a nut threadedly engageable with the axle threaded distal end to retain the wheel on the axle.

The apparatus includes a unitary housing defining an aperture and a chamber in communication with the aperture for receiving and accommodating therein the threaded distal end of an axle projecting through the aperture into the chamber. The chamber is of a size and configuration to additionally receive and accommodate therein a nut threadedly engaging the axle threaded distal end for bringing the unitary housing into frictional engagement with a roller skate wheel whereby the housing will rotate with the roller skate wheel frictionally engaged thereby about the axle.

At least one light bulb is attached to the unitary housing and rotatable with the unitary housing about the axle responsive to rotation of the wheel frictionally engaged by the unitary housing.

At least one battery is mounted on the unitary housing in selective electrical communication with the at least one light bulb.

A translucent cover is connected to the unitary housing for covering the at least one light bulb and rotatable with the unitary housing and bulb responsive to rotation of the wheel frictionally engaged by the unitary housing.

The unitary housing includes a mounting plate and a boss extending from the mounting plate. The boss defines the chamber and has an end wall spaced from the mounting plate and forming the aperture. The mounting plate defines an opening spaced from the aperture and in at least partial registry therewith. The aperture has a circumference larger than the circumference of the threaded distal end and smaller than the outer periphery of the nut threadedly engageable with the threaded distal end.

As will be seen below, the components of the decorative lighting apparatus of the present invention are arranged in such a manner as to render the apparatus compact in construction and substantially balanced about the axis of rotation thereof.

Other features, advantages, and objects of the present invention will become apparent with reference to the following description and accompanying drawings.

BEST MODE FOR CARRYING OUT THE INVENTION

Figure 1:
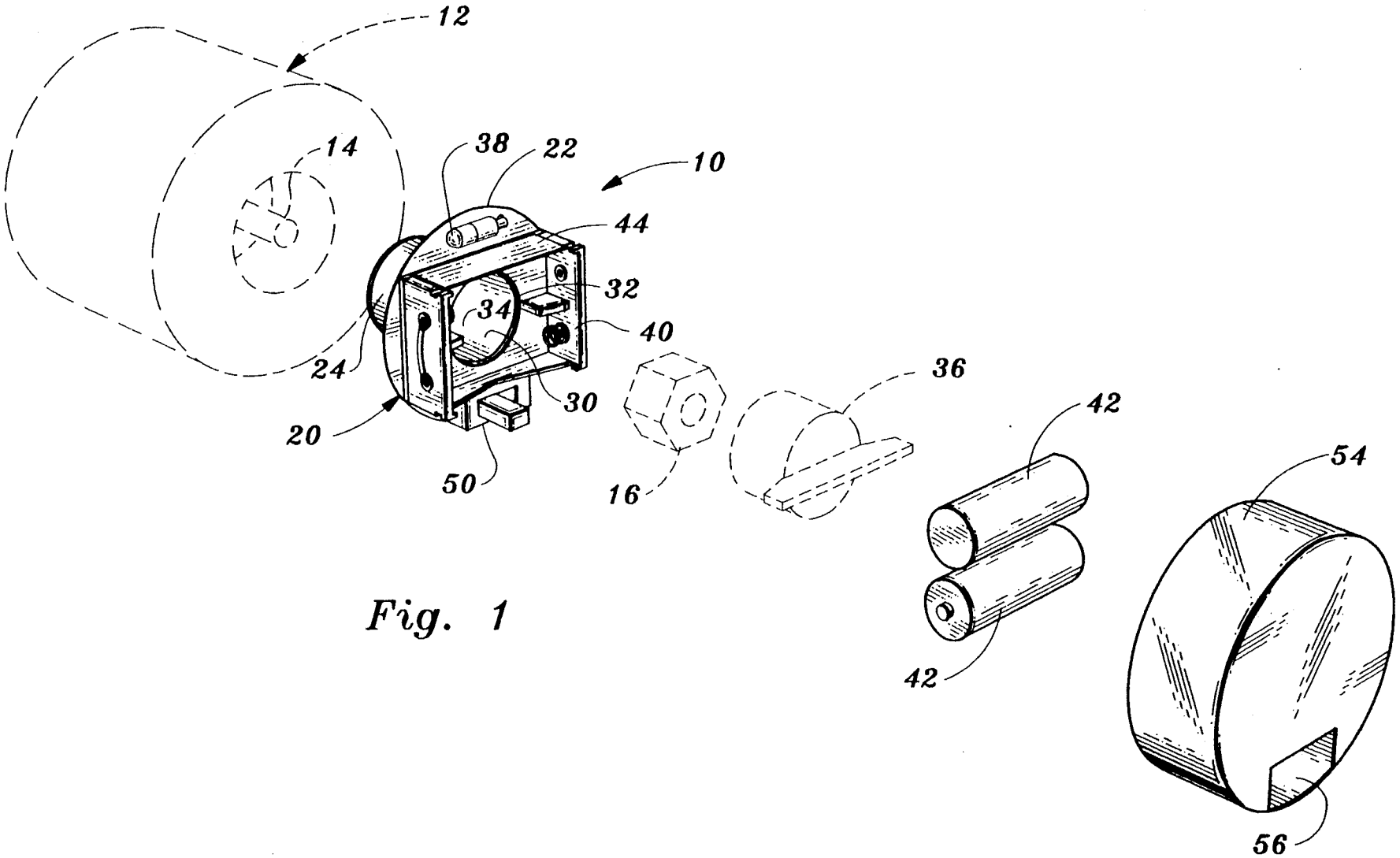
FIG. 1 is an exploded, perspective view of components of the apparatus prior to assembly thereof with a skate wheel and axle.
Figure 2:
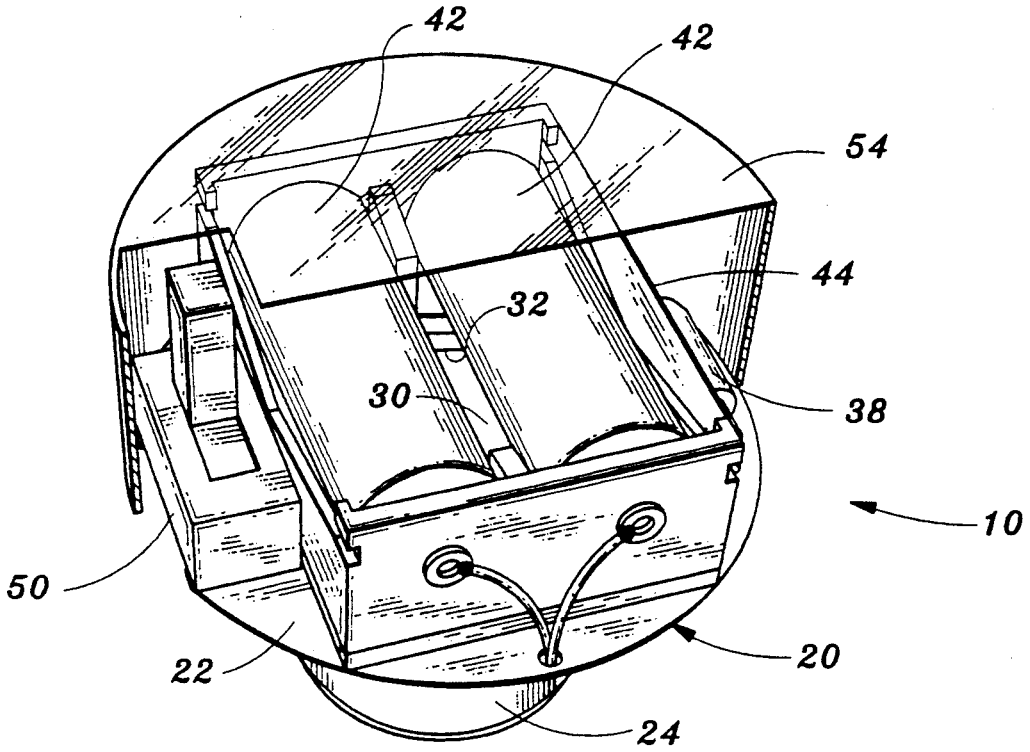
FIG. 2 is an enlarged, perspective view of the apparatus of the present invention with the cover thereof sectioned to show other operative components of the apparatus.
Figure 3:
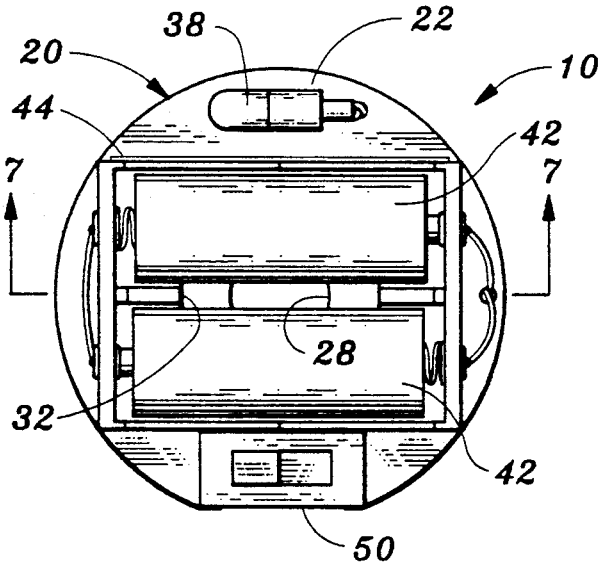
FIG. 3 is a top view of the apparatus with the cover removed.
Figure 4:
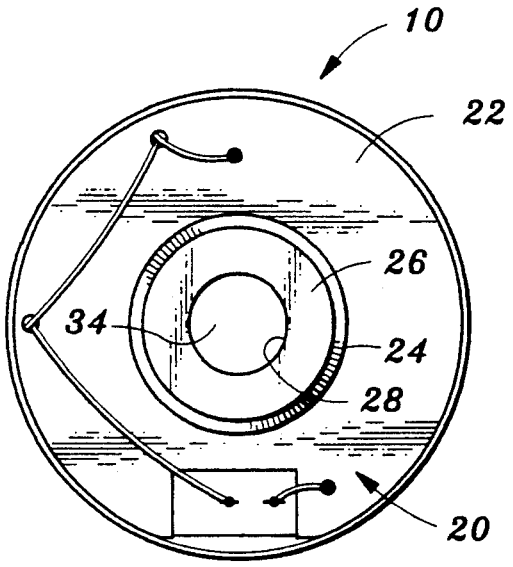
FIG. 4 is a bottom view of the apparatus.
Figure 5:
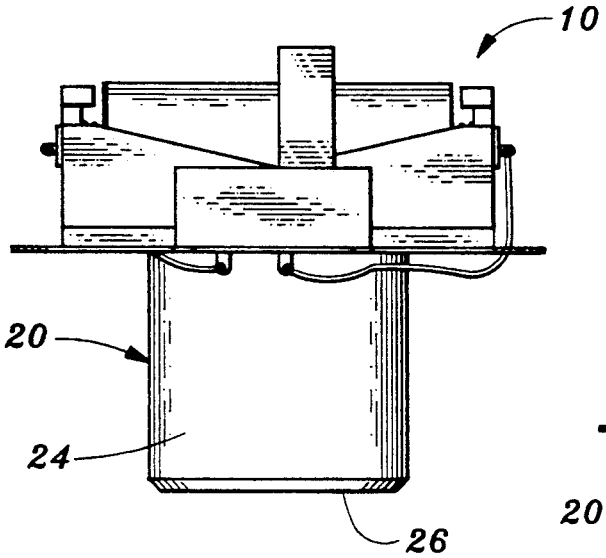
FIG. 5 is a front, elevational view of the apparatus without the cover.
Figure 6:
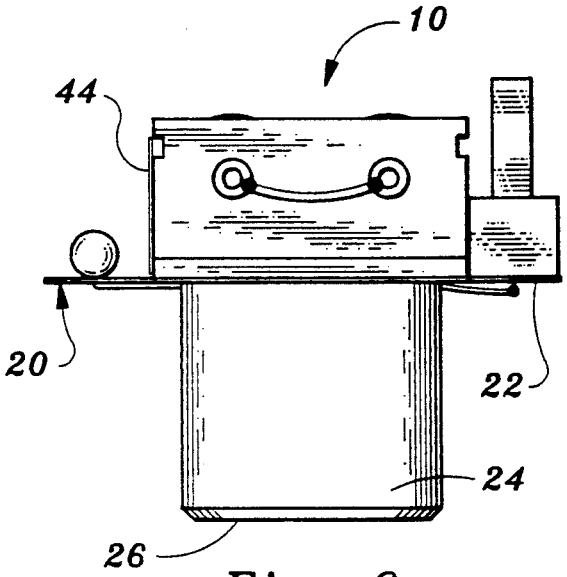
FIG. 6 is a side, elevational view of the apparatus without the cover.
Figure 7:
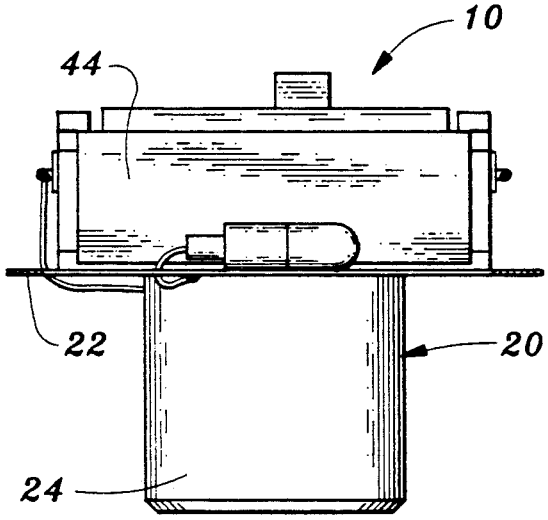
FIG. 7 is a rear, elevational view of the apparatus without the cover.

Referring now to the drawings, apparatus constructed in accordance with the teachings of the present invention is designated generally by reference numeral 10. Apparatus 10 is for attachment to a roller skate wheel 12 and to an axle rotatably supporting the wheel, the axle having a threaded distal end 14. As is conventional, a nut 16 is threadedly engageable with the axle threaded distal end to retain the wheel 12 on the axle.

Apparatus 10 includes a unitary housing 20 constructed of any suitable material such as metal or plastic.

Unitary housing 20 includes a mounting plate 22 and a boss 24 extending from the mounting plate.

The boss 24 has an end wall 26 forming an aperture 28. The aperture 28 has a circumference larger than the circumference of the threaded distal end 14 of the axle and smaller than the outer periphery of the nut 16.

Boss 24 has an inner boss wall 30 leading from end wall 26 and terminating at an opening 32 formed in mounting plate 22. The boss end wall 26 and inner boss wall 30 define a chamber 34. Aperture 28 and opening 32 are centered with respect to unitary housing 20 and are in partial registry, as shown. The mounting plate opening and the chamber 34 are of a size and configuration permitting positioning of a skate key 36 of conventional construction (see FIG. 1) so that the nut 16 may be tightened or loosened in place within the chamber 34 with respect to boss end wall 26.

Figure 8:
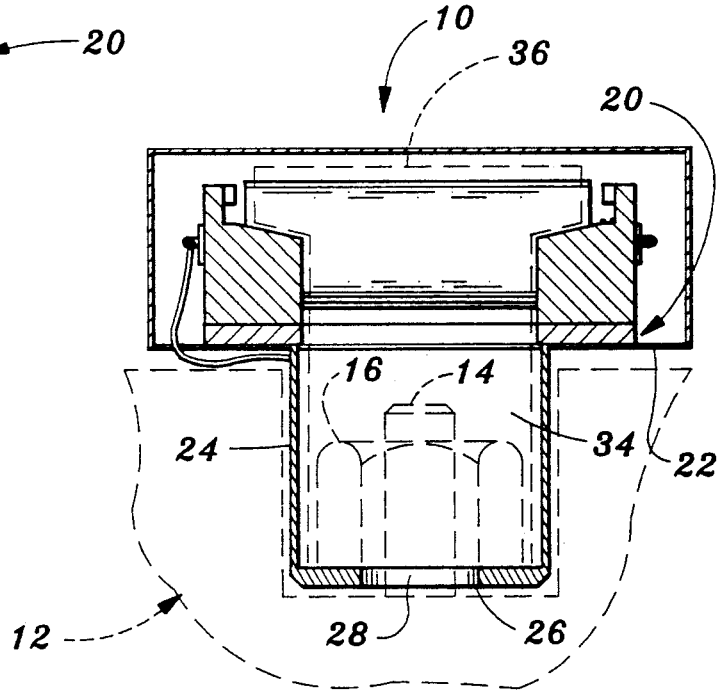
FIG. 8 is a sectional view of the apparatus attached to a skate wheel and axle.

To attach the apparatus 10 to the skate wheel and axle, the nut 16 is removed from the threaded distal end 14 of the axle. The threaded distal end 14 is then inserted into aperture 28 so that it projects into chamber 34. The nut 16 is then threadedly engaged on the threaded distal end 14 of the axle to bring the unitary housing 20 into frictional engagement with wheel 12 so that apparatus 10 will rotate along with the wheel about the axle. FIG. 8 illustrates engagement between the housing 20 and the wheel between the boss end wall 26 and the inner hub of the roller skate wheel.

Mounted on mounting plate 22 is a light bulb 38 which will rotate with the wheel 12 along with the unitary housing 20.

Also connected to mounting plate 22 is a battery holder 40 which accommodates therein two batteries 42. The batteries 42 are inserted into the battery holder 40 after the unitary housing 20 has been secured to the wheel and axle in the manner described above. The holder is centered relative to the mounting plate 22 and has an opening therein in substantial registry with the mounting plate opening 32. Bulb 38 is operatively associated with the batteries through conventional contacts formed in the holder and wiring which is connected to a simple on-off switch 50 utilized to open and close the circuit between the bulb and batteries. It is to be noted that the bulb 38 and switch 50 are fixed to the mounting plate 22 on opposed sides of both the battery holder and the mounting plate opening 32. Such an arrangement results in a more even balance of the apparatus 10 as it rotates along with skate wheel 12 than would otherwise be the case. Reflector tape 44 is applied to mounting plate adjacent to bulb 38 to reflect light from the bulb.

Apparatus 10 also includes a translucent cover 54 which may be attached to unitary housing 20 by any known expedient such as frictional engagement with the outer periphery of mounting plate 22. The translucent cover provides protection for the other elements of the apparatus while at the same time allowing observation of the circular movement of bulb 38 as the skate wheel rotates. The cover 54, which may be formed of clear plastic or other suitable material, has an opening 56 therein which is placed in registry with switch 50 to permit actuation thereof.

I claim:

1. Decorative lighting apparatus for connection to a wheel and to an axle of a roller skate, said axle rotatably supporting said wheel, said axle having a threaded distal end and said roller skate additionally including a nut threadedly engageable with said axle threaded distal end to retain said wheel on said axle, said apparatus comprising, in combination:

a unitary housing defining an aperture and a chamber in communication with said aperture for receiving and accommodating therein said axle threaded distal end projecting through said aperture into said chamber, said chamber being of a size and configuration to additionally receive and accommodate therein said nut threadedly engaging said threaded distal end for bringing said unitary housing into frictional engagement with a roller skate wheel whereby said housing will rotate with the roller skate wheel frictionally engaged thereby about the axle;

at least one light bulb attached to said unitary housing and rotatable with said unitary housing about the axle responsive to rotation of the wheel frictionally engaged by the unitary housing;

at least one battery mounted on said unitary housing in selective electrical communication with said at least one light bulb; and a translucent cover connected to said unitary housing for covering said at least one light bulb and rotatable with said unitary housing and bulb responsive to rotation of the wheel frictionally engaged by the unitary housing, said unitary housing including a mounting plate and a boss extending from said mounting plate, said boss defining said chamber and having an end wall spaced from said mounting plate and said end wall forming said aperture, said mounting plate defining an opening spaced from said aperture and in at least partial registry therewith, said aperture having a circumference larger than a circumference of the threaded distal end and smaller than an outer periphery of the nut threadedly engageable with said threaded distal end.

2. The decorative lighting apparatus according to claim 1 wherein said boss has an inner boss wall leading from said end wall and terminating at said mounting plate opening to define said chamber, said mounting plate opening and said chamber being of a size and configuration permitting positioning of a skate key in said chamber to engage a nut in the chamber.

3. The decorative lighting apparatus according to claim 2 additionally comprising battery holder means for holding said at least one battery closely adjacent to and in at least partial registry with said mounting plate opening to at least partially cover said mounting plate opening.

4. The decorative lighting apparatus according to claim 4 wherein said battery holder means is affixed to said mounting plate and centered relative to said mounting plate.

5. The decorative lighting apparatus according to claim 4 additionally comprising a switch for selectively establishing electrical communication between said at least one light bulb and said at least one battery, said switch and said at least one light bulb being affixed to said mounting plate on opposed sides of both said battery holder means and said mounting plate opening.

* * * * *